US012799842B2

(12) United States Patent
Minassa et al.

(10) Patent No.: US 12,799,842 B2
(45) Date of Patent: Nov. 17, 2026

(54) SEAL-BORE ARRANGEMENT FOR A WELLBORE TUBING DISCONNECTION TOOL

(71) Applicant: Halliburton Energy Services, Inc., Houston, TX (US)

(72) Inventors: Lorenzzo Minassa, The Woodlands, TX (US); Paul James, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/819,547

(22) Filed: Aug. 29, 2024

(65) Prior Publication Data

US 2026/0063015 A1 Mar. 5, 2026

(51) Int. Cl.
*E21B 33/129* (2006.01)
*E21B 33/12* (2006.01)

(52) U.S. Cl.
CPC ..... *E21B 33/1294* (2013.01); *E21B 33/1212* (2013.01)

(58) Field of Classification Search
CPC .. E21B 33/1212; E21B 33/1294; E21B 34/10; E21B 41/0035; E21B 17/003; E21B 17/026; E21B 47/12; E21B 41/0042; E21B 17/0285
See application file for complete search history.

(56) References Cited

U.S. PATENT DOCUMENTS

2008/0029274 A1* 2/2008 Rytlewski ..... E21B 17/1035 166/380
2009/0301733 A1* 12/2009 Shuster ..... E21B 43/106 166/207
2016/0359252 A1 12/2016 Duong
2017/0107794 A1* 4/2017 Steele ..... E21B 17/003
2021/0324722 A1* 10/2021 Xiao ..... E21B 43/38
2022/0333445 A1* 10/2022 Steele ..... E21B 17/025
2023/0212915 A1* 7/2023 Keane ..... E21B 47/135 166/65.1

FOREIGN PATENT DOCUMENTS

WO 9204525 A1 3/1992
WO 2017213726 A2 12/2017

OTHER PUBLICATIONS

Application No. PCT/US2024/049746, International Search Report and Written Opinion, mailed On May 19, 2025, 11 pages.

* cited by examiner

*Primary Examiner* — Yanick A Akaragwe
(74) *Attorney, Agent, or Firm* — Kilpatrick Townsend & Stockton LLP

(57) ABSTRACT

A disconnect tool can be positioned downhole in a wellbore for facilitating one or more electrical or hydraulic connections with one or more downhole tools. The disconnect tool can include a receptacle sub-assembly. The receptacle sub-assembly can include a seal-bore with a first section and a second section. The receptacle sub-assembly can also include a circulation port. The circulation port can extend between the first section and the second section. Thus, a first portion of a lateral surface area of the circulation port can be defined by the first section and a second portion of the lateral surface area of the circulation port can be defined by the second section. The disconnect tool can further include a stinger sub-assembly couplable with the receptacle sub-assembly.

20 Claims, 8 Drawing Sheets

SEAL-BORE ARRANGEMENT FOR A WELLBORE TUBING DISCONNECTION TOOL

TECHNICAL FIELD

The present disclosure relates generally to wellbore operations and, more particularly (although not necessarily exclusively), to a seal-bore arrangement for a wellbore tubing disconnection tool.

BACKGROUND

Wellbore operations can involve the use of various downhole tools designed to facilitate drilling, completion, and maintenance of wells for the extraction of hydrocarbons. Examples of such downhole tools can include a tubular extension (e.g., a stinger) and one or more control lines. The tubular extension can extend into a wellbore from a tubing string to facilitate the delivery of hydraulic fluids or other suitable fluids, application of hydraulic pressure, or serve as a conduit for electrical signals. The fluids, hydraulic pressure, or electrical signals can be transferred from the tubular extension to the wellbore or to other downhole tools via the control lines.

DETAILED DESCRIPTION

Figure 1:
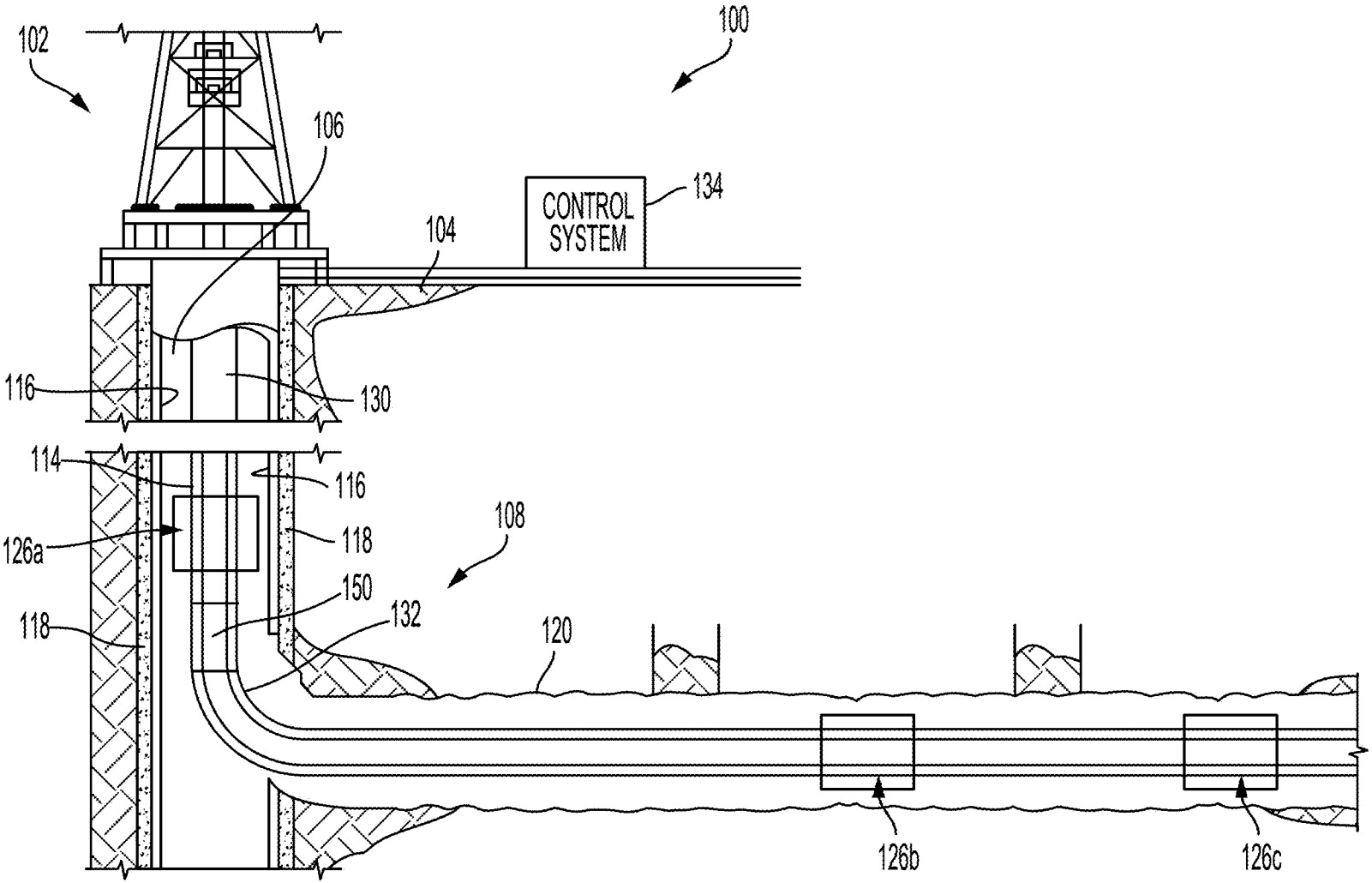
FIG. 1 depicts an example of a well system that can include a wellbore tubing disconnection tool according to some embodiments of the present disclosure.

Certain aspects and examples of the present disclosure relate to a seal-bore arrangement for a wellbore tubing disconnection tool (i.e., a disconnect tool). The disconnect tool can enable an up-hole portion of a tubing string (e.g., a portion of the tubing string above the disconnect tool) to be removed from a wellbore for maintenance, to facilitate replacement of downhole tools, or the like. In doing so, the disconnect tool can further enable connection and disconnection of control lines. The disconnect tool can include a stinger sub-assembly and a receptacle sub-assembly. The stinger sub-assembly can be inserted into and coupled with the receptacle sub-assembly. While coupled, the stinger sub-assembly and the receptacle sub-assembly can facilitate the connection and use of a set of channels and associated control lines for various purposes. For example, some of the channels and associated control lines can be used to control electrically-actuated downhole tools while other channels and control lines may be used to control hydraulically-actuated downhole tools. The seal-bore arrangement of the disconnect tool can facilitate a gas and fluid tight seal between the stinger sub-assembly and the receptacle sub-assembly. This can prevent damage to or disruption of operations at the channels and control lines. For example, the stinger sub-assembly can include various seals (e.g., control line seals, annulus seals, etc.). When the stinger sub-assembly is inserted into the receptacle sub-assembly, the dual seal-bore arrangement of the receptacle sub-assembly can come into contact with the various seals resulting in the gas and fluid tight seal.

In some examples, the dual seal-bore arrangement can include a seal-bore with an upper section and a lower section. The upper section can be the section of the seal-bore that is positioned further up-hole (i.e., closer to a surface of the wellbore) when the disconnect tool is positioned in the wellbore. The upper section can house, and therefore isolate, control line seals of the stinger sub-assembly. When housed by the upper section, the control line seals can facilitate a fluid tight seal around ports (e.g., hydraulic ports) in the receptacle sub-assembly. The ports can provide a passageway for connection between the channels and the control lines. Thus, the fluid tight sealing of these ports can enable each channel and control line to separately connect to and control or actuate a downhole tool. Additionally, the isolation of the control line seals by the upper section can prevent reservoir depletion from increasing a pressure differential at the control line seals. Thus, it may not be necessary to de-rate hydraulic supply pressure.

Additionally, the lower section can house, and therefore isolate, the annulus seals. When housed by the lower section, the annulus seals can provide a fluid and gas tight seal for an annulus between the stinger sub-assembly and the receptacle sub-assembly. In this way, damage (e.g., corrosion, deformation, etc.) to the disconnect tool, which can result from fluids entering the annulus between the stinger and receptacle sub-assembly, pressure differentials with respect to the annulus, or the like, can be prevented. The annulus seals can include one or more metal-to-metal seals. The use of the metal-to-metal seals can prevent gas from migrating to the control lines. More specifically, the metal-to-metal seals can prevent gas migration in situations (e.g., in electric submersible pump applications) in which bottom hole tubing pressure drops below the bubble point (i.e., the pressure at which gas separates from a hydrocarbon fluid). By preventing gas migration to the control lines, uncontrolled emission of gas from the wellbore via the control lines or uncommanded actuation of downhole tools can be prevented. The metal-to-metal seals can be made of a nickel-chromium alloy or other suitable corrosion-resistant metal.

There can further be one or more circulation ports positioned between the upper and lower sections of the seal bore. In one example, there may be three evenly spaced apart circulation ports along a circumference of the receptacle sub-assembly between the upper and lower sections of the seal bore. In other examples, there can be a different number of circulation ports, or the circulation ports may have uneven spacing therebetween. Regardless, each circulation port can be positioned along a circumference of the receptacle sub-assembly. More specifically, each circulation port can be positioned along an interface between the lower section and the upper section of the seal bore. Additionally, each circulation port may extend through the receptacle subassembly. A portion of a lateral surface of each circulation port can therefore be defined by the upper section of the seal-bore and another portion of the lateral surface area of each circulation port can be defined by the lower seal-bore. Consequently, each circulation port can provide an opening between the upper and lower sections of the seal bore, thereby allowing fluids to be pumped and circulated while the stinger sub-assembly is inserted into the receptacle sub-assembly. In this way, any debris between the stinger sub-assembly and the receptacle sub-assembly can be washed out to prevent ports, control lines, or other suitable components of the disconnect tool from being clogged, damaged, or otherwise affected by the debris.

The above features (e.g., the seal-bore with the upper and lower sections, the circulation ports, and the metal-to-metal seals) can solve potential debris and gas migration concerns for wet-mate connectors, travel joints, and polished bore receptacles, or the like. The seal-bore arrangement and corresponding isolation of specific seals can further enable the use of seals not compatible with hydraulic control line fluids (e.g., metal-to-metal seals). This provides improved customization capabilities for the stinger sub-assembly. For example, a variety of seals, including metal-to-metal seals, can be used. The metal-to-metal seals can be more durable and gas-tight than the elastomeric seals typically used in hydraulic control line applications.

In a particular example, the upper section and the lower section of the seal-bore can be positioned at a hydraulic section of the receptacle sub-assembly. There can be undercuts and debris-barrier ball checks positioned along a circumference of the upper section, and the upper section can have a larger inner diameter than the lower section. The larger diameter of the upper section can allow the stinger sub-assembly to be installed in the receptacle sub-assembly without scratching the lower section with the metal-to-metal seal. The stinger sub-assembly can have two seal arrangements (e.g., an upper seal arrangement associated with the upper section of the seal-bore and a lower seal arrangement associated with the lower section of the seal-bore). The upper seal arrangement can include the control line seals for sealing around the ports on the receptacle sub-assembly. In particular, there can be two control line seals per hydraulic channel to facilitate a fluid passageway between a port and a control line. The lower seal arrangement can include the annulus seals, which can include one or more metal-to-metal seals for providing a gas tight arrangement for the disconnect tool downhole. Additionally, at an interface between the upper and lower sections of the seal-bore, there may be three or more circulation ports which can allow fluid circulation during reconnection of the stinger sub-assembly with the receptacle sub-assembly. This can facilitate proper cleaning of the receptacle upper section of the seal-bore and associated components.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 depicts an example of a well system 100 that can include a wellbore tubing disconnection tool (e.g., a disconnect tool 150) according to some embodiments of the present disclosure. As illustrated, the well system 100 may include wellhead equipment 102 arranged at a surface 104. A wellbore 106 can extend from the surface 104 into a subterranean formation 108. The wellhead equipment 102 may encompass a drilling rig, a wellhead installation, a Christmas tree, a work-over rig, a service rig, or the like. The wellhead equipment 102 can be used to facilitate production operations, stimulation operations, completion operations, or other suitable operations performed with respect to the wellbore 106. Although FIG. 1 depicts a land-based well system, in other examples, the disconnect tool and associated components can be used in subsea well systems or other suitable types of well systems.

A wellbore tubular 114 can extend into the wellbore 106. The wellhead equipment 102 may be used to support or position the wellbore tubular 114 in the wellbore 106. The wellbore tubular 114 may include drill string, casing string, production tubing, landing string, liners, coiled tubing, combinations thereof, or the like. As illustrated in FIG. 1, the wellbore 106 may extend substantially vertically away from the surface 104. In other examples, the wellbore 106 or portions of the wellbore 106 may be oriented in other directions with respect to the surface (e.g., the wellbore 106 may include a substantially horizontal or curved portion).

The wellbore 106 may be at least partially cased with a casing string 116. The casing string 116 may be at least partially secured downhole within the wellbore 106 using, for example, cement 118. In the example shown, a lower portion of wellbore tubular 114 may extend into a substantially horizontal portion 120 of the wellbore 106, which may be an uncased or "open hole" section of the wellbore 106.

The well system 100 may further include one or more downhole devices 126*a-c* positioned within or coupled to the wellbore tubular 114. Examples of downhole devices include sensor devices (pressure, temperature, density, fluid flow etc.), pumps, packers, gauges, valves, chokes, and other devices used to monitor and control operations performed in the wellbore. In other examples, the well system 100 can have a different number of downhole devices than is shown in FIG. 1.

A control system 134 may control various aspects of the operations performed with respect to the wellbore 106. The control system 134 can include processor and memory resources that can control various aspects of the operation of the well system 100. In some aspects, the control system may be coupled to the downhole devices 126*a-c* via hydraulic or electrical control lines that can run in control line channels of the wellbore tubular 114. Although shown as being at the surface, the control system 134 can be located anywhere within the well system 100.

The well system 100 further includes a disconnect tool 150. The disconnect tool 150 can be a wet-mate connector, such as an electrical-hydraulic wet-mate connector. In the example shown, the disconnect tool 150 can be located between an upper portion 130 and a lower portion 132 of the wellbore tubular 114. In other examples, the disconnect tool 150 may be positioned anywhere within a wellbore tubular. During normal operations of the well system 100, wellbore fluids can pass through an interior bore of the disconnect tool 150, and electrical connections, hydraulic connections, or a combination thereof can be maintained through the disconnect tool 150. But, in some examples, it may be desirable over time to remove an upper portion 130 of the wellbore tubular 114 to, for example, perform maintenance work, replace one or more downhole devices 126*a-c*, etc. For example, the disconnect tool 150 can be used to disconnect devices in the upper portion 130 (e.g., downhole device 126*a*). The disconnect tool 150 may also facilitate replacing some surface equipment such as a tubing hanger. In such examples, the upper portion 130 of the wellbore tubular 114 can be removed while the lower portion 132 can remain in position downhole in the wellbore 106. The disconnect tool 150 can enable the upper portion 130 to be reinserted and positioned within the wellbore 106. The disconnect tool 150 can further enable the electrical connections, hydraulic connections, or the combination thereof to be reestablished between the upper portion 130 and lower portion 132 of the wellbore tubular 114.

Figure 2A:
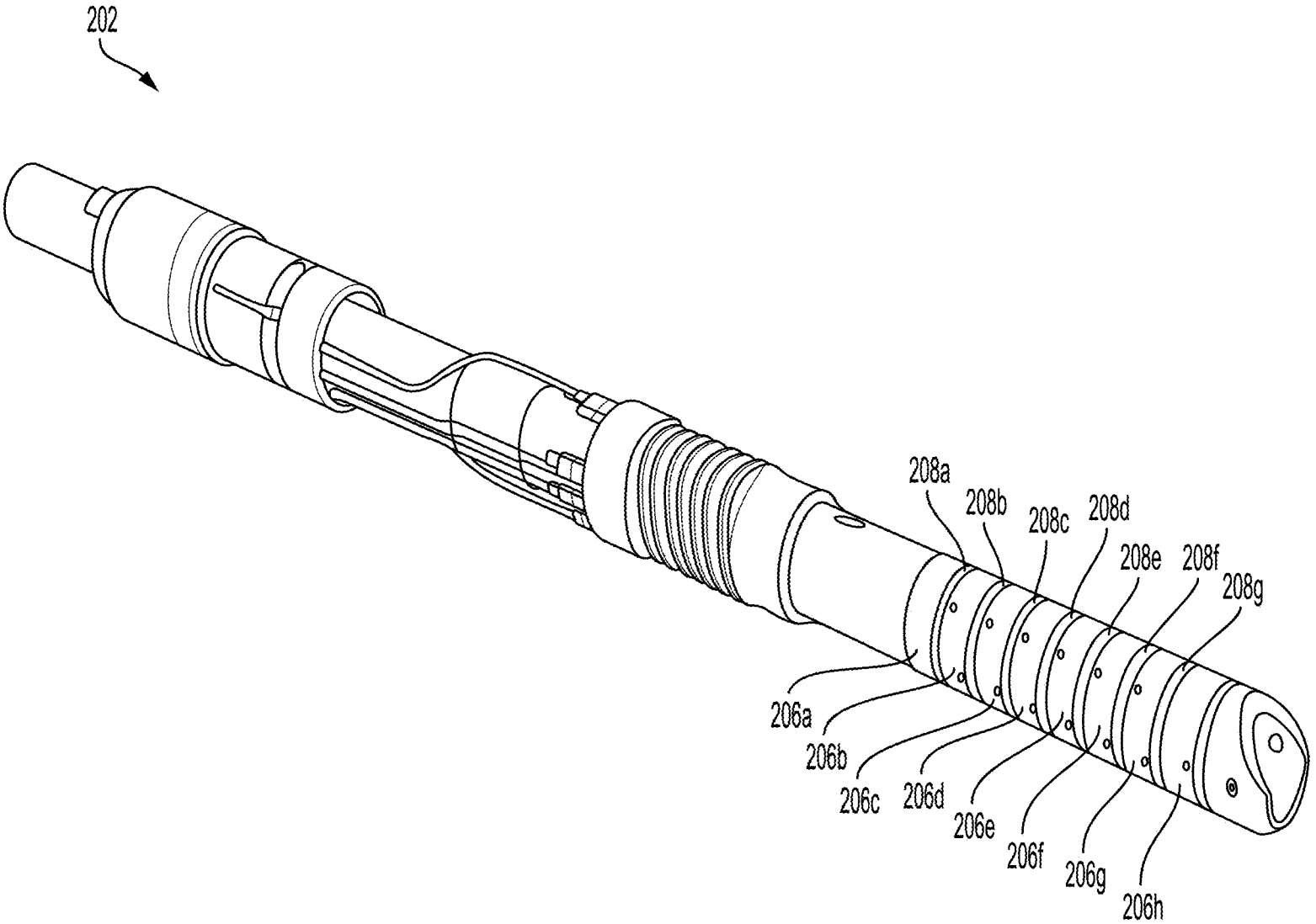
FIG. 2A depicts an example of the wellbore tubing disconnection tool according to some embodiments of the present disclosure.
Figure 2B:
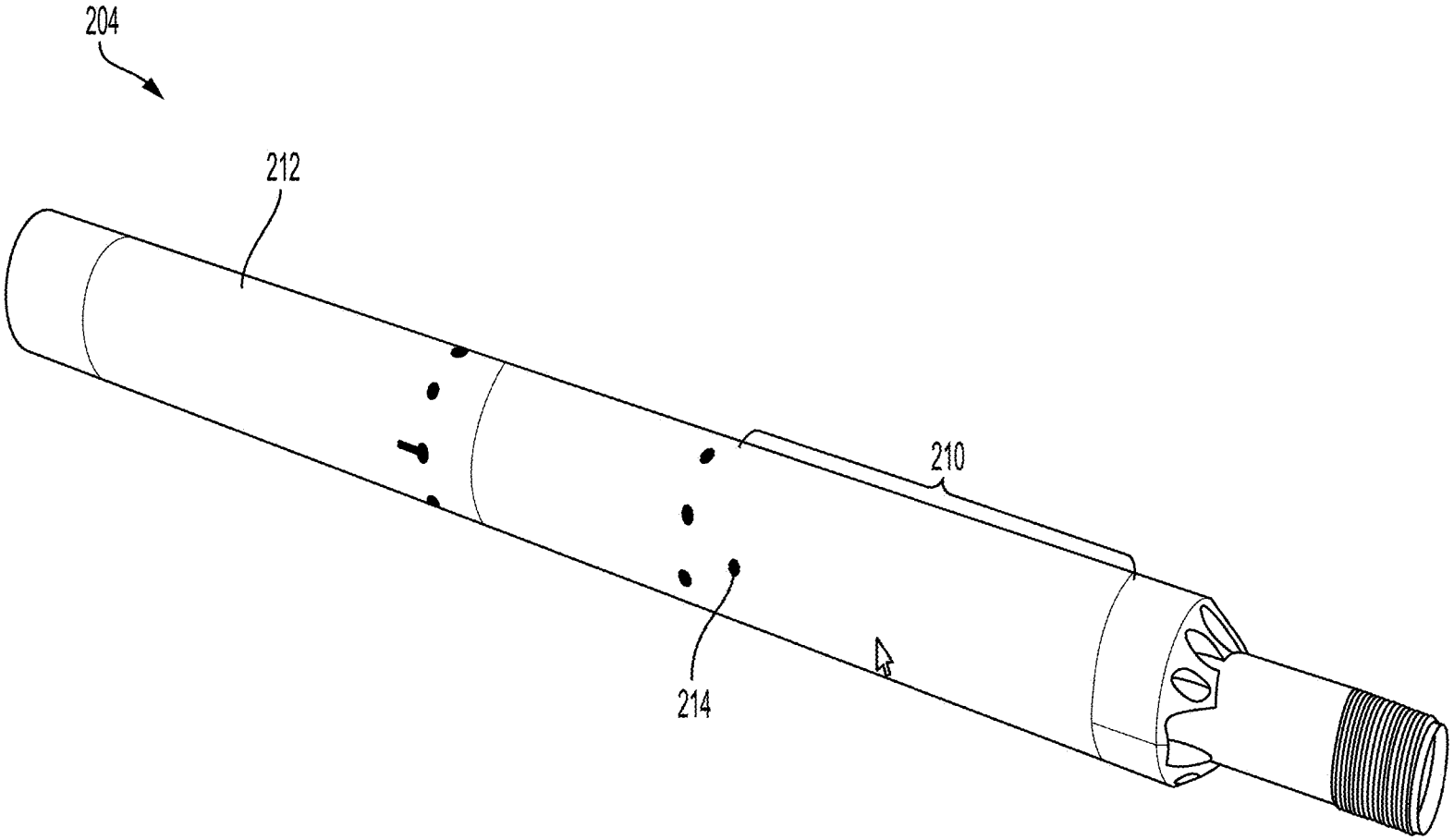
FIG. 2B depicts an example of the wellbore tubing disconnection tool according to some embodiments of the present disclosure.

FIGS. 2A and 2B depict an example of the wellbore tubing disconnection tool (e.g., the disconnect tool 150) according to some embodiments of the present disclosure. More specifically, FIG. 2A depicts an example of a stinger sub-assembly 202 of the disconnect tool 150 and FIG. 2B depicts an example of a receptacle sub-assembly 204 of the disconnect tool 150. The stinger sub-assembly 202 can be a male portion of the disconnect tool 150 while the receptacle sub-assembly 204 can be a female portion of the disconnect tool 150. Thus, the stinger sub-assembly 202 can be removably inserted into a bore 212 of the receptacle sub-assembly 204. When inserted, the stinger sub-assembly 202 can be concentric with the receptacle sub-assembly 204.

In some examples, the stinger sub-assembly 202 can include channels 206*a-h*, which can each be associated with a control line (e.g., a hydraulic control line, an electrical control line, or the like). The stinger sub-assembly 202 can further include seals 208*a-g* for separating each of the channels 206*a-h*. Additionally, a portion of the bore 212 of the receptacle sub-assembly 204 can be a seal-bore 210. The seal-bore 210 may also include grooves, which can correspond to the seals 208*a-g* of the stinger sub-assembly 202. When the stinger sub-assembly 202 is inserted into the receptacle sub-assembly 204, the seal-bore 210 can receive the channels 206*a-h* and a seal can be made between an inner wall of the seal-bore 210 and an outer wall of each of the channels 206*a-h*. Additionally, when the stinger sub-assembly 202 is inserted into the receptacle sub-assembly 204, the grooves can provide an area through which the seals 208*a-g* can pass. As a result, each of the seals 208*a-g* may not be forced into corresponding ports (e.g., port 214) or otherwise damaged when the stinger sub-assembly 202 is within the receptacle sub-assembly 204.

As a result of the separation of the channels 206*a-h* by the seals 208*a-g* and the positioning of the channels 206*a-h* in the seal-bore 210, each of the channels 206*a-h* can act as a separate hydraulic or electrical passage. For example, each of the channels 206*a-h* can be used for injecting or withdrawing different types of fluids in or from the wellbore 106 without contamination. For example, one channel may be used for carrying hydraulic fluids while another channel may be used for injecting chemicals. Additionally or alternatively, different hydraulic pressures can be implemented at each channel. The separation of the channels may further facilitate the separation of electrical and hydraulic control lines. Consequently, the channel separation can facilitate simultaneous and safe use of various downhole tools (e.g., electrically actuated tools and hydraulically actuated tools with varying pressure requirements).

The receptacle sub-assembly 204 can further include one or more control line ports (e.g., ports 214). The ports 214 can be positioned adjacent to one or more of the channels 206*a-h* (e.g., channels used as hydraulic passages) when the stinger sub-assembly 202 is fully inserted into the receptacle sub-assembly 204. The ports 214 can connect to downhole tools such as packers, sliding sleeves, valves, or the like. Thus, the ports 214 can provide a connection point between each of the channels 206*a-h* and one or more downhole tools to facilitate the use of each channel 206*a-h* as a hydraulic or electrical passage for actuating or controlling the one or more downhole tools.

Figure 3:
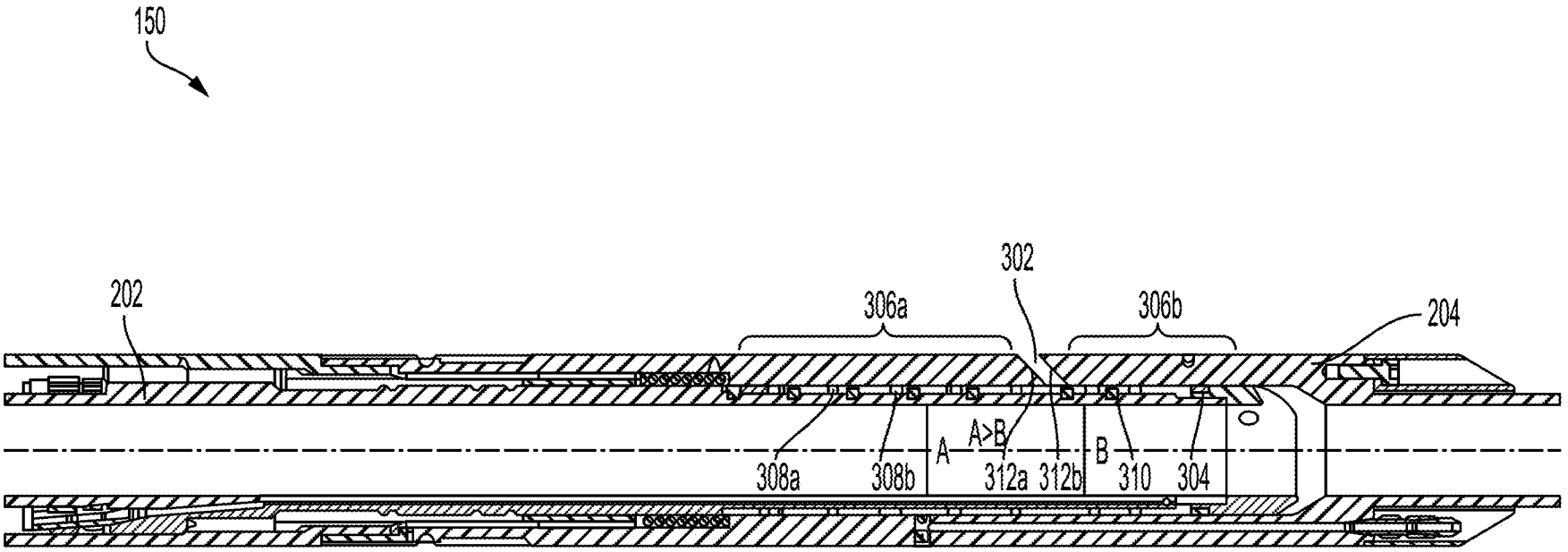
FIG. 3 depicts an example of the wellbore tubing disconnection tool with a seal-bore arrangement according to some embodiments of the present disclosure.

FIG. 3 depicts an example of the wellbore tubing disconnection tool (e.g., disconnect tool 150) with a seal-bore arrangement according to some embodiments of the present disclosure. As described above with respect to FIG. 2, the disconnect tool 150 can include a stinger sub-assembly 202 and a receptacle sub-assembly 204. As shown in FIG. 3, the stinger sub-assembly 202 can be inserted into the receptacle sub-assembly 204 to facilitate one or more downhole hydraulic or electrical connections in a wellbore 106. The seal-bore arrangement of the disconnect tool 150 can include a seal-bore with a first section 306*a* and a second section 306*b*. The seal-bore arrangement can also include a circulation port 302 positioned between the first section 306*a* and the second section 306*b*. The seal-bore arrangement can correspond to a portion of the bore 212 of the receptacle sub-assembly 204. For example, the seal-bore arrangement can correspond to the seal-bore 210 depicted in FIG. 2.

The seal-bore arrangement can receive a portion of the stinger sub-assembly 202 with hydraulic channels, electrical channels, or a combination thereof. For example, when the stinger sub-assembly 202 is positioned within the receptacle sub-assembly 204, the channels 206*a-h* can be adjacent to the first section 306*a* of the seal-bore. The first section 306*a* of the seal bore may be an upper section (e.g., the section positioned closer to a surface 104 of the wellbore 106). The second section 306*b* of the seal-bore can then be a lower section (e.g., the second section 306*b* can be positioned at a greater depth within the wellbore 106 than the first section 306*a*).

Upon landing (e.g., inserting) the stinger sub-assembly 202 in the receptacle sub-assembly 204, the first section 306*a* of the receptacle sub-assembly 204 can encompass components of the stinger sub-assembly 202 in a fluid tight manner. For example, an outer side of the channels 206*a-h* of the stinger sub-assembly 202 can include sealing elements (e.g., control line seals 308*a-b*). The control line seals 308*a-b* can be associated with hydraulic control lines, electrical control line, or the like. The control line seals 308*a-b* can contact the first section 306*a* of the seal-bore upon the positioning of the stinger sub-assembly 202 in the receptacle sub-assembly 204. In this way, the control line seals can facilitate a fluid tight seal between the channels 206*a-h* of the stinger sub-assembly and the ports 214 of the first section 306*a*. The first section 306*a* can further encompass and contact the seals 208*a-g* between the channels 206*a-h* to facilitate a fluid tight seal between the channels 206*a-h* as well.

Additionally, once the stinger sub-assembly 202 is positioned within the receptacle sub-assembly 204, the second section 306*b* of the seal-bore can also encompass components of the stinger sub-assembly 202 in a fluid tight and in a gas tight manner. For example, the stinger sub-assembly 202 can further include one or more annulus seals. The annulus seals can provide pressure isolation for an annulus between the stinger sub-assembly 202 and the receptacle sub-assembly 204. The annulus seals can further prevent fluid leaks to or from a surrounding environment (e.g., outside of the receptacle sub-assembly 204), thereby preventing damage to the disconnect tool 150, uncontrolled hydrocarbon release, etc. The annulus seals can include at least one metal-to-metal seal 304. The metal-to-metal seal

304 can provide a gas and fluid tight, durable and long-lasting seal between the stinger sub-assembly 202 and the second section 306*b* of the seal-bore of the receptacle sub-assembly 204. The annulus seals may also include at least one nonmetallic (e.g., elastomeric, plastic, or the like) seal 310 for providing an additional seal between the stinger sub-assembly 202 and the second section 306*b* of the seal-bore.

Additionally, in some examples, the sections 306*a-b* of the seal-bore can include undercuts (e.g., grooves), debris barriers, or a combination thereof. For example, the first section 306*a* can include undercuts and debris barriers, while the second section 306*b* may include the debris barriers and exclude the undercuts. The debris barriers can block and thereby reduce an amount of debris that can enter the fluid passageways, or other suitable portions of the seal-bore. In particular, the debris barriers may block the debris from entering port 214 when the stinger sub-assembly 202 is not engaged with the receptacle sub-assembly. Then, upon the stinger sub-assembly 202 landing in the receptacle sub-assembly 204, the debris barrier can be disengaged to allow fluid communication along the fluid pathways (from 206 through 214), or a combination thereof.

Additionally, between the sections 306*a-b* of the seal-bore, there can be at least one circulation port 302. In some examples, there can be multiple circulation ports 302 (e.g., at least two) evenly distributed about a circumference of the receptacle sub-assembly 204. In other examples, at least some of the circulation ports 302 may have an uneven distribution about the circumference. Each of the circulation ports 302 can be defined by an opening that traverses a wall of the receptacle sub-assembly 204 at an interface between the sections 306*a-b* of the seal-bore. Consequently, a least a portion of a lateral surface area 312*a* of the circulation port 302 can be defined by the first section 306*a*, while the remainder of the lateral surface area 312*b* of the circulation port 302 can be defined by the second section 306*b*. The circulation port may have a substantially cylindrical cross-section, or the cross-section of the circulation port may have another shape. In some examples, the circulation port 302 can be oriented in an up-hole direction. That is, a longitudinal axis of the circulation port can be greater than 90 degrees with respect to an inner wall of the second section 306*b* of the seal-bore. For example, as shown, the longitudinal axis of the circulation port 302 can be at a 120-degree angle with respect to an inner wall of the second section 306*b* of the seal-bore. In other examples, the circulation ports 302 may be at a 90-degree angle or at an angle between 5 and 175 degrees with respect to the inner wall of the second section 306*b* of the seal-bore.

The circulation ports 302 can facilitate debris removal from the first section 306*a* of the seal-bore as the stinger sub-assembly 202 is inserted into the receptacle sub-assembly 204. For example, a cleaning fluid can be directed into the receptacle sub-assembly 204 through the tubing string 114 during insertion of the stinger sub-assembly 202. The fluid can then circulate and be vented out of receptacle sub-assembly 204 via the circulation port(s) 302. Thus, any debris, which may be lodged in the ports 214, undercuts, or the like of the first section 306*a* of the seal-bore, can be cleaned out as the stinger sub-assembly 202 is inserted. Debris in the second section 306*b* may also be dislodged and flushed out the circulation ports 302 or allowed to settle down the tubing string 114 due to the fluid flow coming from surface through the stinger. As a result, performance of the channels 206*a-h* and ports 214 as hydraulic or electrical passageways and the control lines corresponding to the channels can be enhanced.

In some examples, a portion of the receptacle sub-assembly 204 corresponding to the first section 306*a* of the seal-bore may have a greater inner diameter than a portion of the receptacle sub-assembly 204 corresponding to the second section 306*b* of the seal-bore. For example, inner diameter A can be greater than inner diameter B (e.g., by as little as a few thousandths of an inch). This can prevent the metal-to-metal seal 304 from scratching the first section 306*a* while landing the stinger sub-assembly 202 (e.g., while inserting the stinger sub-assembly 202 into the receptacle sub-assembly 204).

Figure 4:
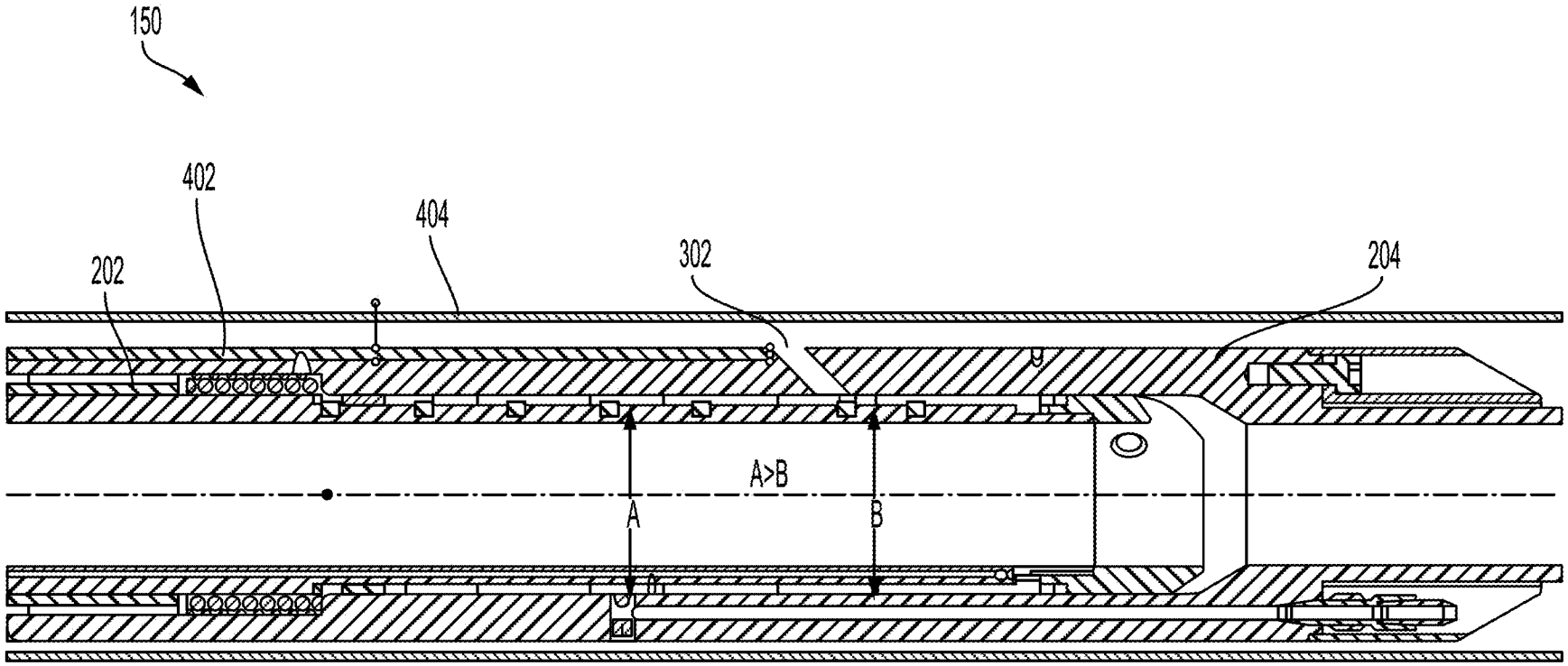
FIG. 4 depicts an additional example of the wellbore tubing disconnection tool with the seal-bore arrangement according to some embodiments of the present disclosure.

FIG. 4 depicts an additional example of the wellbore tubing disconnection tool (e.g., disconnect tool 150) with the seal-bore arrangement according to some embodiments of the present disclosure. FIG. 4 depicts a casing 404, which can encompass the disconnect tool 150. In some examples, an annulus between the casing 404 and an outer wall of the receptacle sub-assembly 204 can be relatively small and therefore may inhibit the circulation of the fluid from the circulation ports 302. In such examples, there can be one or more slots 402 within the receptacle sub-assembly 204. The slots 402 can provide additional space for fluid flow, which can improve circulation and thereby enable higher hydraulic flow rates to be used downhole to facilitate cleaning.

Figure 5:
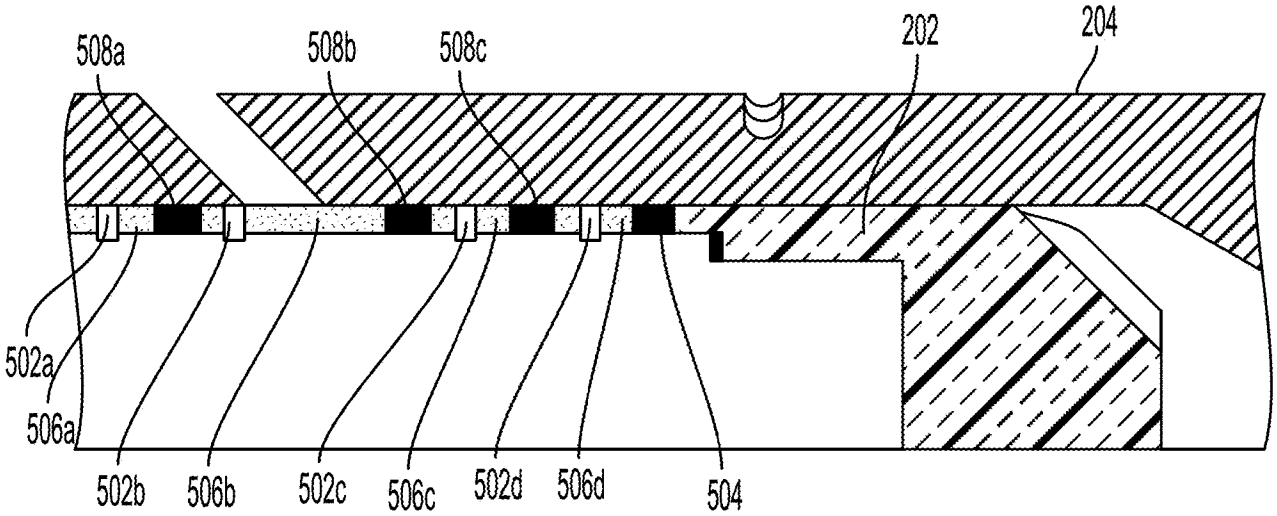
FIG. 5 depicts an example of a seal arrangement for the seal-bore arrangement according to some embodiments of the present disclosure.

FIG. 5 depicts an example of a seal arrangement for the seal-bore arrangement according to some embodiments of the present disclosure. As shown, the seal-bore arrangement can include various types of seals. For example, the seal-bore arrangement can include a metal-to-metal seal 504 and nonmetallic (e.g., elastomeric) seals 508*a-c*. The metal-to-metal seal 504 and the elastomeric seals can be part of or coupled with the stinger sub-assembly 202. When the stinger sub-assembly is inserted into the metal-to-metal seal 504 and the elastomeric seals can come into contact with an inner wall of the receptacle sub-assembly 204 to create a gas and fluid tight seal between the stinger sub-assembly 202 and the receptacle sub-assembly 204.

The seal-bore arrangement can further include seal spacers 506*a-d*, which can also be coupled with or part of the stinger sub-assembly 202. The seal spacers 506*a-d* can be positioned between the metal-to-metal and elastomeric seals to prevent over compression or under compression of each of the seals. In doing so, the seal spacers 506*a-d* can facilitate even pressure distribution across the seals to prevent leaks or other suitable failures of the seals. In some examples, the seal spacers 506*a-d* can be coupled with the stinger sub-assembly 202 via lock screws 502*a-d*. The lock screws 502*a-d* can prevent loosening of the seal spacers 506*a-d* due to the movement, pressure, vibrations, or the like associated with inserting the stinger sub-assembly 202 into or removing the stinger sub-assembly 202 from the receptacle sub-assembly 204.

Figure 6:
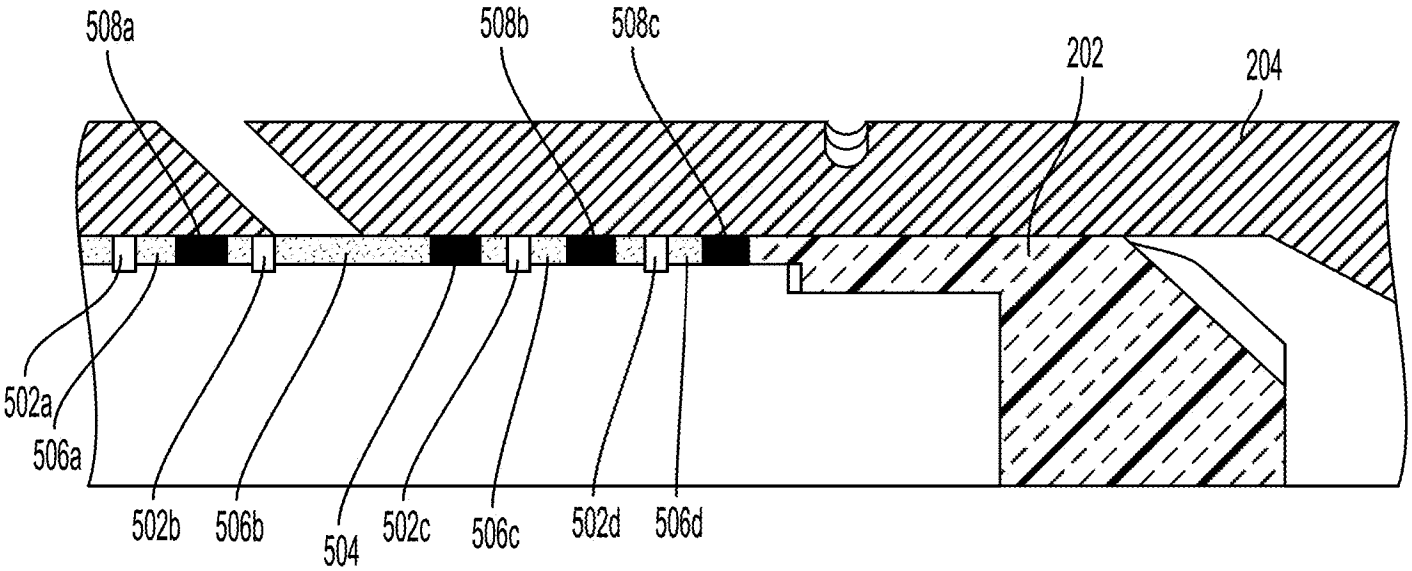
FIG. 6 depicts an additional example of a seal arrangement for the seal-bore arrangement according to some embodiments of the present disclosure.

FIG. 6 depicts an additional example of a seal arrangement for the seal-bore arrangement according to some embodiments of the present disclosure. FIG. 6 can also include the elastomeric seals 508*a-c*, the metal-to-metal seal 504, the seal spacers 506*a-d*, and the lock screws 502*a-d*. But, in FIG. 6 the metal-to-metal seal 504 can be in a different position (e.g., closer to the circulation port 302). Although two examples of the seal arrangement are shown, in additional embodiments there may a different number of metal-to-metal or elastomeric seals used or additional types of seals used. Additionally, the seals can be positioned anywhere along the stinger sub-assembly 202 and can be any distance apart.

Figure 7:
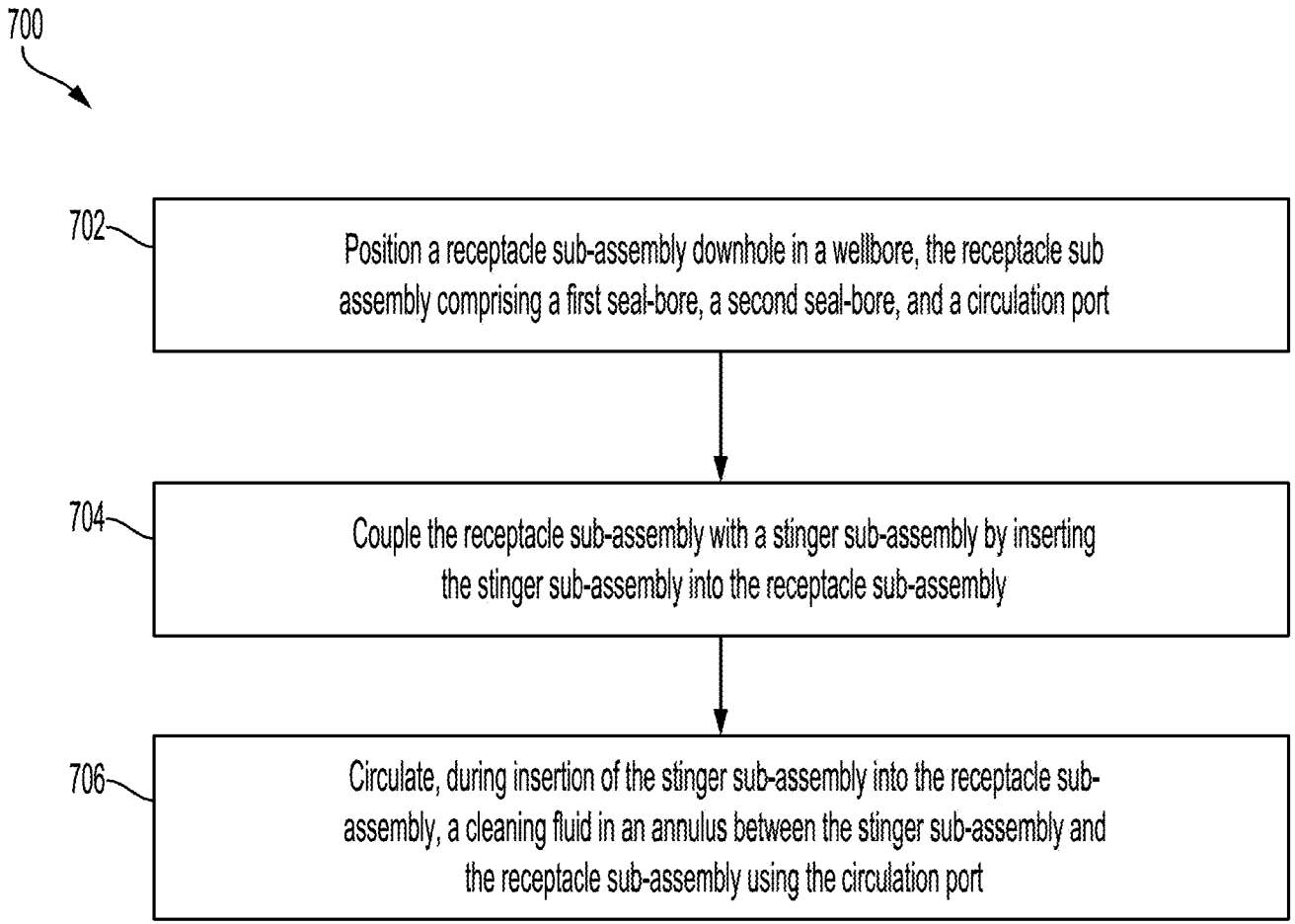
FIG. 7 is a flowchart of an example of a process for positioning the disconnect tool with the seal-bore arrangement downhole in a wellbore according to some embodiments of the present disclosure.

FIG. 7 is a flowchart of an example of a process 700 for positioning the disconnect tool with a seal-bore arrangement downhole in a wellbore according to some embodiments of the present disclosure. In other examples, the process 700 can include more steps, fewer steps, different steps, or a different order of the steps depicted in FIG. 7. The steps of FIG. 7 are described below with reference to components discussed above in FIGS. 1-6.

At block 702, the process 700 can involve positioning a receptacle sub-assembly 204 downhole in a wellbore 106. The receptacle sub-assembly 204 can include a seal-bore with a first section 306*a* and a second section 306*b*. The receptacle sub-assembly can also include a circulation port 302. In some examples, the receptacle sub-assembly 204 can include more than one circulation port 302, which may be evenly distributed along a circumference of the receptacle sub-assembly. The circulation port 302 can be extend through the seal-bore (e.g., traverse a wall of the receptacle sub-assembly correspond to the seal-bore) at an interface of the first section 306*a* and the second section 306*b*.

At block 704, the process 700 can involve coupling the receptacle sub-assembly 204 with a stinger sub-assembly 202 by inserting the stinger sub-assembly 202 into the receptacle sub-assembly 204. The stinger sub-assembly 202 can include a first arrangement of seals that, upon the coupling of the receptacle sub-assembly 204 and the stinger sub-assembly 202, can be positioned adjacent to the first section 306*a* of the seal-bore. The stinger sub-assembly 202 can also include a second arrangement of seals that, upon the coupling of the receptacle sub-assembly 204 and the stinger sub-assembly 202, can be positioned adjacent to the second section 306*b* of the seal-bore. The first section of seals can include control line seals while the second section of seals may include metal-to-metal seals.

At block 706, the process 700 can involve circulating, during insertion of the stinger sub-assembly 202 into the receptacle sub-assembly 204, a cleaning fluid in an annulus between the stinger sub-assembly 202 and the receptacle sub-assembly 204 using the circulation port 302. For example, a cleaning fluid can be directed into the receptacle sub-assembly 204 through the tubing string 114 during insertion of the stinger sub-assembly 202. The fluid can then circulate and be vented out of receptacle sub-assembly 204 via the circulation port(s) 302. In doing so, debris from an environment of the wellbore can be washed out of the annulus. The circulation port 302 can provide a conduit through which the cleaning fluid and the debris can be vented out of the annulus.

In some aspects, systems and methods associated with a dual seal-bore arrangement for a wellbore tubing disconnection tool are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a disconnect tool positionable downhole in a wellbore, the disconnect tool comprising: a receptacle sub-assembly comprising: a seal-bore with a first section and a second section; and a circulation port extending between the first section and the second section such that a first portion of a lateral surface area of the circulation port is defined by the first section and a second portion of the lateral surface area of the circulation port is defined by the second section; and a stinger sub-assembly couplable with the receptacle sub-assembly.

Example 2 is the system of example(s) 1, wherein the stinger sub-assembly comprises at least one metal-to-metal seal positionable adjacent to the second section of the seal-bore to prevent gas migration in one or more control lines associated with the first section of the seal-bore.

Example 3 is the system of example(s) 1-2, wherein a longitudinal axis of the circulation port is oriented in an up-hole direction.

Example 4 is the system of example(s) 1-3, wherein a first inner diameter of the receptacle sub-assembly associated with the first section of the seal-bore is greater than a second inner diameter of the receptacle sub-assembly associated with the second section of the seal-bore, wherein the first section is positionable at a lesser depth in the wellbore than the second section.

Example 5 is the system of example(s) 1-4, wherein the stinger sub-assembly comprises a plurality of channels and a plurality of seals, wherein each seal of the plurality of seals is positioned between two channels of the plurality of channels.

Example 6 is the system of example(s) 1-5, wherein the plurality of channels is positioned adjacent to the first section of the seal-bore upon insertion of the stinger sub-assembly into the receptacle sub-assembly.

Example 7 is the system of example(s) 1-6, wherein the receptacle sub-assembly comprises a plurality of control line ports, wherein each control line port of the plurality of control line ports is positionable adjacent to a channel of the plurality of channels upon insertion of the stinger sub-assembly into the receptacle sub-assembly.

Example 8 is a disconnect tool comprising: a receptacle sub-assembly positionable downhole in a wellbore, the receptacle sub-assembly comprising: a seal-bore with a first section and a second section, the first section being positionable at a lesser depth in the wellbore than the second section; and a circulation port extending between the first section and the second section such that a first portion of a lateral surface area of the circulation port is defined by the first section and a second portion of the lateral surface area of the circulation port is defined by the second section; and a stinger sub-assembly insertable into the receptacle sub-assembly, the stinger sub-assembly comprising a plurality of channels and a plurality of annulus seals.

Example 9 is the disconnect tool of example(s) 8, wherein the plurality of annulus seals comprises at least one metal-to-metal seal, and wherein the at least one metal-to-metal seal is positionable adjacent to the second section of the seal-bore to prevent gas migration in one or more control lines associated with the first section of the seal-bore.

Example 10 is the disconnect tool of example(s) 8-9, wherein a longitudinal axis of the circulation port is oriented in an up-hole direction.

Example 11 is the disconnect tool of example(s) 8-10, wherein a first inner diameter of the receptacle sub-assembly associated with the first section of the seal-bore is greater than a second inner diameter of the receptacle sub-assembly associated with the second section of the seal-bore.

Example 12 is the disconnect tool of example(s) 8-11, wherein the stinger sub-assembly further comprises a plurality of seals, wherein each seal of the plurality of seals is positioned between two channels of the plurality of channels.

Example 13 is the disconnect tool of example(s) 8-12, wherein the plurality of channels is positioned adjacent to the first section of the seal-bore upon insertion of the stinger sub-assembly into the receptacle sub-assembly.

Example 14 is the disconnect tool of example(s) 8-13, wherein the receptacle sub-assembly comprises a plurality of control line ports, wherein each control line port of the plurality of control line ports is positionable adjacent to a channel of the plurality of channels upon insertion of the stinger sub-assembly into the receptacle sub-assembly.

Example 15 is a method comprising: positioning a receptacle sub-assembly downhole in a wellbore, the receptacle sub-assembly comprising: a seal-bore with a first section and a second section; and a circulation port extending between the first section and the second section such that a first portion of a lateral surface area of the circulation port is defined by the first section and a second portion of the lateral surface area of the circulation port is defined by the second section; coupling the receptacle sub-assembly with a stinger sub-assembly by inserting the stinger sub-assembly into the receptacle sub-assembly; and circulating, during insertion of the stinger sub-assembly into the receptacle sub-assembly, a cleaning fluid in an annulus between the stinger sub-assembly and the receptacle sub-assembly using the circulation port.

Example 16 is the method of example(s) 15, further comprising positioning a metal-to-metal seal between the stinger sub-assembly and the second section of the seal-bore to prevent gas migration in one or more control lines associated with the first section of the seal-bore.

Example 17 is the method of example(s) 15-16, wherein a longitudinal axis of the circulation port is oriented in an up-hole direction Example 18 is the method of example(s) 15-17, wherein positioning the receptacle sub-assembly downhole in the wellbore comprises positioning the first section of the seal-bore at a lesser depth in the wellbore than the second section of the seal-bore.

Example 19 is the method of example(s) 15-18, wherein the stinger sub-assembly comprises a plurality of channels and a plurality of seals, and wherein coupling the receptacle sub-assembly with the stinger sub-assembly comprises positioning the plurality of channels adjacent to the first section of the seal-bore.

Example 20 is the method of example(s) 15-19, wherein the receptacle sub-assembly comprises a plurality of control line ports, wherein coupling the receptacle sub-assembly with the stinger sub-assembly comprises positioning each control line port of the plurality of control line ports adjacent to a channel of the plurality of channels.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a disconnect tool positionable downhole in a wellbore, the disconnect tool comprising:

a receptacle sub-assembly comprising:

a seal-bore with a first section and a second section; and a circulation port extending between the first section and the second section such that a first portion of a lateral surface area of the circulation port is defined by the first section and a second portion of the lateral surface area of the circulation port is defined by the second section;

a stinger sub-assembly couplable with the receptacle sub-assembly; and an annulus extending between the receptacle sub-assembly and the stinger sub-assembly, the annulus being defined by an outer surface area of the stinger sub-assembly and an inner surface area of the receptacle sub-assembly, wherein the circulation port is positionable adjacent to the annulus during insertion and removal of the stinger sub-assembly to and from the receptacle sub-assembly to provide fluid communication between the annulus and an exterior of the disconnect tool during the insertion and the removal of the stinger sub-assembly to and from the receptacle sub-assembly.

2. The system of claim 1, wherein the stinger sub-assembly comprises at least one metal-to-metal seal positionable adjacent to the second section of the seal-bore to prevent gas migration in one or more control lines associated with the first section of the seal-bore.

3. The system of claim 1, wherein a longitudinal axis of the circulation port is oriented in an up-hole direction.

4. The system of claim 1, wherein a first inner diameter of the receptacle sub-assembly associated with the first section of the seal-bore is greater than a second inner diameter of the receptacle sub-assembly associated with the second section of the seal-bore, wherein the first section is positionable at a lesser depth in the wellbore than the second section.

5. The system of claim 1, wherein the stinger sub-assembly comprises a plurality of channels and a plurality of seals, wherein each seal of the plurality of seals is positioned between two channels of the plurality of channels.

6. The system of claim 5, wherein the plurality of channels is positioned adjacent to the first section of the seal-bore upon insertion of the stinger sub-assembly into the receptacle sub-assembly.

7. The system of claim 5, wherein the receptacle sub-assembly comprises a plurality of control line ports, wherein each control line port of the plurality of control line ports is positionable adjacent to a channel of the plurality of channels upon insertion of the stinger sub-assembly into the receptacle sub-assembly.

8. A disconnect tool comprising:

a receptacle sub-assembly positionable downhole in a wellbore, the receptacle sub-assembly comprising:

a seal-bore with a first section and a second section, the first section being positionable at a lesser depth in the wellbore than the second section; and a circulation port extending between the first section and the second section such that a first portion of a lateral surface area of the circulation port is defined by the first section and a second portion of the lateral surface area of the circulation port is defined by the second section;

a stinger sub-assembly insertable into the receptacle sub-assembly, the stinger sub-assembly comprising a plurality of channels and a plurality of annulus seals; and an annulus extending between the receptacle sub-assembly and the stinger sub-assembly, the annulus being defined by an outer surface area of the stinger sub-assembly and an inner surface area of the receptacle sub-assembly, wherein the circulation port is positionable adjacent to the annulus during insertion and removal of the stinger sub-assembly to and from the receptacle sub-assembly to provide fluid communication between the annulus and an exterior of the disconnect tool during the insertion and the removal of the stinger sub-assembly to and from the receptacle sub-assembly.

9. The disconnect tool of claim 8, wherein the plurality of annulus seals comprises at least one metal-to-metal seal, and wherein the at least one metal-to-metal seal is positionable adjacent to the second section of the seal-bore to prevent gas migration in one or more control lines associated with the first section of the seal-bore.

10. The disconnect tool of claim 8, wherein a longitudinal axis of the circulation port is oriented in an up-hole direction.

11. The disconnect tool of claim 8, wherein a first inner diameter of the receptacle sub-assembly associated with the first section of the seal-bore is greater than a second inner diameter of the receptacle sub-assembly associated with the second section of the seal-bore.

12. The disconnect tool of claim 8, wherein the stinger sub-assembly further comprises a plurality of seals, wherein each seal of the plurality of seals is positioned between two channels of the plurality of channels.

13. The disconnect tool of claim 8, wherein the plurality of channels is positioned adjacent to the first section of the seal-bore upon insertion of the stinger sub-assembly into the receptacle sub-assembly.

14. The disconnect tool of claim 8, wherein the receptacle sub-assembly comprises a plurality of control line ports, wherein each control line port of the plurality of control line ports is positionable adjacent to a channel of the plurality of channels upon insertion of the stinger sub-assembly into the receptacle sub-assembly.

15. A method comprising:

positioning a receptacle sub-assembly of a disconnect tool downhole in a wellbore, the receptacle sub-assembly comprising:

a seal-bore with a first section and a second section; and a circulation port extending between the first section and the second section such that a first portion of a lateral surface area of the circulation port is defined by the first section and a second portion of the lateral surface area of the circulation port is defined by the second section;

coupling the receptacle sub-assembly with a stinger sub-assembly of the disconnect tool by inserting the stinger sub-assembly into the receptacle sub-assembly; and circulating, during insertion of the stinger sub-assembly into the receptacle sub-assembly, a cleaning fluid between an annulus and an exterior of the disconnect tool using the circulation port, the annulus being defined by an outer surface area of the stinger sub-assembly and an inner surface area of the receptacle sub-assembly, and the annulus being positioned adjacent to the circulation port during the insertion of the stinger sub-assembly into the receptacle sub-assembly.

16. The method of claim 15, further comprising positioning a metal-to-metal seal between the stinger sub-assembly and the second section of the seal-bore to prevent gas migration in one or more control lines associated with the first section of the seal-bore.

17. The method of claim 15, wherein a longitudinal axis of the circulation port is oriented in an up-hole direction.

18. The method of claim 15, wherein positioning the receptacle sub-assembly downhole in the wellbore comprises positioning the first section of the seal-bore at a lesser depth in the wellbore than the second section of the seal-bore.

19. The method of claim 15, wherein the stinger sub-assembly comprises a plurality of channels and a plurality of seals, and wherein coupling the receptacle sub-assembly with the stinger sub-assembly comprises positioning the plurality of channels adjacent to the first section of the seal-bore.

20. The method of claim 19, wherein the receptacle sub-assembly comprises a plurality of control line ports, wherein coupling the receptacle sub-assembly with the stinger sub-assembly comprises positioning each control line port of the plurality of control line ports adjacent to a channel of the plurality of channels.

* * * * *